US005773089A

United States Patent [19]

Burch et al.

[11] Patent Number: 5,773,089

[45] Date of Patent: Jun. 30, 1998

[54] PROCESS FOR TREATING ARAMID SURFACES TO BE PLATED

[75] Inventors: Robert R. Burch, Exton, Pa.; Che H. Hsu, Wilmington, Del.

[73] Assignee: E. I. du Pont de Nemours and Company, Wilmington, Del.

[21] Appl. No.: 769,024

[22] Filed: Dec. 18, 1996

[51] Int. Cl.[6] ..... B05D 3/10; B05D 1/18

[52] U.S. Cl. ..... 427/304; 427/305; 427/307; 427/314; 427/443.1; 427/434.6

[58] Field of Search ..... 427/307, 305, 427/304, 314, 443.1, 434.6

[56] References Cited

U.S. PATENT DOCUMENTS

| | | | |
|---|---|---|---|
| 4,667,024 | 5/1987 | Sitrin et al. | 536/16.9 |
| 5,024,858 | 6/1991 | Burch | 427/123 |
| 5,302,415 | 4/1994 | Gabara et al. | 427/306 |
| 5,399,425 | 3/1995 | Burch | 428/328 |
| 5,422,142 | 6/1995 | Hsu | 427/306 |
| 5,453,299 | 9/1995 | Hsu | 427/306 |
| 5,453,430 | 9/1995 | Hsu | 427/306 |
| 5,545,430 | 8/1996 | Magera et al. | 427/98 |

FOREIGN PATENT DOCUMENTS

| | | |
|---|---|---|
| 49073337 | 7/1974 | Japan . |

*Primary Examiner*—Shrive Beck
*Assistant Examiner*—Michael Barr

[57] ABSTRACT

A process is disclosed for preparing an aramid surface to be metal plated by nonaqueous treatment with a strong base followed by water washing—all in the absence of metal cations.

10 Claims, No Drawings

PROCESS FOR TREATING ARAMID SURFACES TO BE PLATED

BACKGROUND OF THE INVENTION

1. Field of the Invention

This invention relates to preparation of aramid surfaces for electroless metal plating wherein the metal is strongly adhered to the aramid surface substrate and provides a highly conductive plated surface. The aramid is subjected to a preplating treatment which includes contact of the aramid with a solution of a strong base in dimethyl sulfoxide followed by washing and, if desired, drying. The aramid, whether dried or not, after the treatment, can be electrolessly plated with strongly adherent metal.

2. Description of the Prior Art

Simple processes for electrolessly plating aramid surfaces with strongly adherent metals have been long sought. Aramid surfaces have been plated by electroless processes which inherently cause a loss in strength of the substrate material and by processes which require complicated and cumbersome treatment steps of the aramid surfaces to be plated. For example, U.S. Pat. No. 5,302,415, issued Apr. 12, 1994 on the application of Gabara et al., discloses that aramid surfaces can be electrolessly plated, provided that the aramid is first treated by a concentrated sulfuric acid to such a degree that the aramid is cracked or otherwise changed morphologically. Such cracking or changing causes some loss of strength in the aramid.

U.S. Pat. No. 5,024,858, issued Jun. 18, 1991 on the application of Burch, discloses that aramid surfaces can be electrolessly plated provided that the aramid is treated with a strong base to form anionic sites on the aramid, followed immediately by contact with metal cations to be electrostatically bonded to the anionic sites and by reduction of those metal cations to yield an aramid surface sensitized for plating by an electroless process. The step of reacting anionic sites by contacting the aramid surface with metal cations followed by the step of reducing the cations before electroless plating, complicates the plating process and adds significantly to the cost and time required for completing the plating process.

SUMMARY OF THE INVENTION

The present invention provides a process for preparing an aramid surface to be plated with a durable metal coating wherein, during the entire course of the process, the aramid surface is kept from contact with metal cations;—the process comprising the steps of contacting the aramid surface with a nonaqueous solution of a strong base and washing the base-contacted aramid surface with water until substantially all of the base is removed.

A process is also provided for plating the aramid surface so-prepared. In practice of the plating process of the present invention, it is preferred that the activating metal for copper or nickel plating is palladium; and, for silver, the activator is silver, itself. There are no metals involved in practice of the base-contacting process of the present invention. The preferred aramid is poly(para-phenylene terephthalamide) (PPD-T).

DETAILED DESCRIPTION OF THE INVENTION

There has long been a need for conductive aramid fibers which have durable metallic coatings; and that need is especially acute for fibers which must also exhibit high strength and modulus.

Fibers of aramids have been difficult to plate with a durable metal coating. Aramid fiber surface treatments and pretreatments have been, generally, up to now, cumbersome and not entirely satisfactory.

This invention provides a process for treating and electrolessly plating aramid surfaces at increased plating rates, using simplified procedures, and in a way that yields a treated surface, on fibers, of maintained strength and modulus and a metal coating which is highly conductive and strongly adherent. The process is conducted without contacting the aramid surface with metal cations at any time prior to plating. The process can be conducted on a continuous basis or batch-wise. Because the present preferred use for this invention is in the treatment of aramid fiber surfaces, the aramid surfaces of this invention may sometimes be described herein as aramid fibers.

By "aramid" is meant a polyamide wherein at least 85% of the amide (-CO-NH-) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. No. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride or the aramid. As a special case, it has been found that up to as much as 30 percent, by weight, of polyvinyl pyrrolidone can be included with poly(p-phenylene terephthalamide) in aramid fibers to be plated by the process of this invention.

Para-aramids are the primary polymers in fibers of this invention and poly(p-phenylene terephthalamide)(PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

Meta-aramids are, also, important for use in the fibers of this invention and poly(m-phenylene isophthalamide) (MPD-I) is the preferred meta-aramid. By MPD-I is meant the homopolymer resulting from mole-for-mole polymerization of m-phenylene diamine and isophthaloyl chloride and, also, copolymers resulting from incorporation of small amounts of other diamines with the m-phenylene diamine and of small amounts of other diacid chlorides with the isophthaloyl chloride. As a general rule, other diamines and other diacid chlorides can be used in amounts up to as much as about 10 mole percent of the m-phenylene diamine or the isophthaloyl chloride, or perhaps slightly higher, provided only that the other diamines and diacid chlorides have no reactive groups which interfere with the polymerization reaction. MPD-I, also, means copolymers resulting from incorporation of other aromatic diamines and other aromatic diacid chlorides, provided, only that the other aromatic diamines and aromatic diacid chlorides be present in amounts which do not interfere with the desired performance characteristics of the aramid.

Aramid fibers made by wet or air-gap spinning processes of the previously-mentioned patents are coagulated into a so-called "never-dried" form wherein the fiber includes considerably more than 75 weight percent water. Because never-dried fibers shrink extensively during loss of the water, a strongly adherent metal coating can be plated onto the fibers only after the fibers have been dried to less than about 20 weight percent water in order to collapse the polymer structure of the fiber. Never-dried fibers cannot successfully be plated by the process of this invention due to the shrinkage of fibers as they are subsequently dried. Fibers eligible for use in the process of the present invention are dried fibers having a moisture content of less than 20 weight percent, preferably less than 5 percent.

As a first step in the process of this invention, the aramid surfaces to be treated are contacted with a nonaqueous solution of a strong base. The strong base is believed to generate anionic sites on the surfaces.

Other strong bases which can be used in the process of this invention include alkali metal compounds such as: hydroxides (OH—); $R^4R^5N$—, wherein $R^4$ and $R^5$ are selected from the group consisting of $C_1$–$C_{12}$ alkyl, $C_6H_5$, $C_{10}H_7$, $C_{12}H_9$, C(=O)$R^6$ wherein $R^6$ is $C_1C_{12}$ alkyl; $CH_2CN$-; $R^7$— wherein $R^7$ is $C_1$–$C_{12}$ alkyl; H—; $R^8SOR^9$— wherein R8 and $R^9$ are each $C_1$–$C_{12}$ alkyl; or $R^{10}O$— wherein $R^{10}$ is $C_1$–$C_{12}$ alkyl; and the polyanions of the polymers desribed above.

By "strong base" is meant any base whose conjugated acid has a pKa in DMSO greater than 19 and, preferably, a pKa in DMSO greater than 29. Such an acid with pKa greater than 19 should deprotonate the first hydrogen of PPD-T; and, with a pKa greater than 29, should fully deprotonate PPD-T. [reference: R. R. Burch, W. Sweeny, H-W Schmidt and Y. H. Kim, Macromolecules, vol. 23, 1065 (1990)]. For example, potassium tert-butoxide (tert-butyl alcohol, pKa=32), sodium methoxide (methanol, pKa=29), and sodium amide (ammonia, pKa=41), among others, are all useful to prepare an anionic form of aramids, such as PPD-T as long as they are soluble in the DMSO.

The preferred bases include $R^8SOR^9$— and $R^{10}O$—. The most preferred bases are $CH_2SOCH_3$—, potassium t-butoxide, and the polyanions of the polymers described above, either used alone or in the presence of alcohols or amines. The concentration of base in solution can range from 0.05M to 6M. The most preferred range is 0.1M to 1.0M.

Solvents which are suitable for use in this invention include sulfoxides such as $R^{11}SOR^{12}$ wherein $R^{11}$ and $R^{12}$ can be the same or different and are $C_1$–$C_5$ alkyl. The most preferred solvent is dimethylsulfoxide (DMSO).

Solvent and solvent mixtures which are suitable include $R^{11}SOR^{12}$ and $R^{11}SOR^{12}$ mixed with a polar non-protic solvent such as N-methylpyrrolidone or tetrahydrofuran. Preferred solvent mixtures contain greater than 10% DMSO. Most preferred solvent mixtures contain greater than 50% DMSO. It is important to the present invention that the combination of base and solvent cause swelling of the polymers, as this permits improved contact with the reagents. Solvents and solvent combinations which cause swelling are known in the art. See, for example, U.S. Pat. No. 4,785,038.

The process of the present invention can be operated at temperatures which depend on the particular solvent that is employed, typically at temperatures between the melting and boiling points of said solvent. For example, when the solvent is DMSO, the temperature range will be 15° C. to 190° C. The preferred temperature range is 15° C. to about 60° C.

The aforementioned contact should be continued until the aramid surface starts to change to orange or get tacky, which are indications that anionic sites have been generated. The time required for completion of this process step is about 1 to 60 seconds at 25° C.; and, of course, is less when conducted at higher temperatures and greater when conducted at lower temperatures.

The base-contacted aramid surface is then washed well with water to remove substantially all of the base. It should be noted that previous processes, wherein anionic sites were generated, required that the anionic sites be utilized by immediate reaction with metal cations or other sensitizing material and by strict isolation from water prior to such reaction. In the process of this invention, the fibers are washed with water immediately after contacting the fibers with base and there is no interim contact of the fibers with metal cations or other sensitizing material.

Following the water washing step, the fibers can, if desired, be dried. The intended use for the base-contacted surface of this invention is electroless metal plating. The treated surface can be dried prior to plating or it can be plated after the washing step without drying. If the treated surface is dried, it should be dried under conditions which will not cause deterioration of the aramid. The surface can be dried in air or nitrogen or other gaseous atmosphere not detrimental to the fiber and the drying temperatures can range from 10° C. or 15° C. to 100° C. or perhaps slightly higher. The preferred drying temperature is 15° C. to 80° C.

The washed surface, whether dried or not, is plated by immersion in an aqueous solution of cations to be plated.

For an example of a copper plating process, an aqueous sensitizing solution, sometimes known as an activation bath is prepared using palladium and tin cations as activation catalyst. The base-contacted and washed PPD-T fibers to be plated are immersed in the activation bath and agitated to promote activation of the fiber surfaces. The fibers are removed from the activation bath and rinsed and may, if desired, be transferred to an accelerator bath of dilute mineral acid. The fibers are then placed in, or conducted through, a plating bath with copper ions and formaldehyde wherein the copper ions are complexed to maintain solution, for example, with tetrasodium salt of ethylenediamine tetraacetic acid (EDTA).

The plating bath, with immersed activated fibers, is moderately agitated for 10 to 20 minutes to assure adequate pick-up. Formaldehyde, pH-adjusting caustic solution, and copper ion solution are added at the rate of depletion. Additions can be made continuously or intermittently. The plated material can then be rinsed and dried. Instead of formaldehyde, other materials can be used as reducing agents. Among the eligible reducing agents are hypophosphite, hydrazine, boron hydride, and the like.

All of the above steps can be conducted with the various baths at temperatures of 10° to 60° C., and preferably 20°–40° C.

For an example of a nickel plating process, the base-contacted fibers are first immersed in an aqueous sensitizing solution as described above. The sensitized fibers are rinsed with water extensively and are then transferred to an aqueous bath which includes a metal complex solution of nickel, ammonia, and dimethylamine borane. During immersion in the metal complex bath, the bath is agitated to ensure that imbibed stannous ions reduce nickel ions to nickel metal on the polymer surface. The dimethylamine borane is added to is the metal complex solution as a reducing agent and nickel ions preferentially deposit on the sensitized polymer surface. The sensitizing solution is used in electroless plating to promote preferential metal deposition onto the desired surfaces.

Instead of copper or nickel, cobalt or the like can be, also, plated on the base-contacted surface with a proper combination of sensitizing solution, reducing agent solution, and metal plating solution.

The plating processes can be conducted on base-contacted fibers which have been dried or which remain wet from the base-contacting step. In the case of copper plating, the plating quality appears to be relatively unaffected by drying the fibers after base contact.

Test Methods

Electrical Resistance

A resistance cell is constructed by mounting 2.5 centimeters long copper electrodes parallel and 2.5 centimeters apart on a flat block of nonconductor such as polyethylene. The electrodes are connected to an ohmmeter such as a Keithley 173A multimeter and the resistance of a fabric is determined by pressing the cell against the fabric positioned on a flat, nonconductive, surface. Resistance is reported as ohms per square.

Linear Density

The linear density of a yarn is determined by weighing a known length of the yarn. Denier is defined as the weight, in grams, of 9000 meters of the yarn. Dtex is the weight, in grams, of 10,000 meters of the yarn.

Tensile Properties

Yarns tested for tensile properties are, first, conditioned and, then, twisted to a twist multiplier of 1. 1. The twist multiplier (TM) of a yarn is defined as:

$$TM=(\text{twists/inch})/(5315/\text{denier of yarn})^{1/2}$$

The yarns to be tested are conditioned at 25° C., 55% relative humidity for a minimum of 14 hours and the tensile tests are conducted at those conditions. Tenacity (breaking tenacity), elongation (breaking elongation), and modulus are determined by breaking test yarns on an Instron tester (Instron Engineering Corp., Canton, Mass.).

Tenacity, elongation, and initial modulus, as defined in ASTM D2101-1985, are determined using yarn gage lengths of 25.4 cm and an elongation rate of 50% strain/minute. The modulus is calculated from the slope of the stress-strain curve at 1% strain and is equal to the stress in grams at 1% strain (absolute) times 100, divided by the test yarn linear density.

DESCRIPTION OF THE PREFERRED EMBODIMENTS

In the examples which follow, all parts are by weight unless specifically stated to be otherwise. Also, all samples were wound on open racks for immersion in the various treatment solutions.

Base-Contacting Fibers

For use in these examples, yarns of finish-free continuous para-aramid filaments (such as the material sold by E. I. du Pont de Nemours and Company under the trade name KEVLAR® 29) were contacted with a solution of base in dimethylsulfoxide (DMSO) for periods of 2.5 to 60 seconds at about 20° C., were thoroughly rinsed with water, wound on a bobbin, and air-dried. The kind and concentration of base, along with contact time is noted in each example.

The base-contacted yarns and a control yarn of the same kind and type, but with no base contact, were machine-knitted into small fabric tubes and were plated in the tubing form. The knitting machine was sold by Scott & Williams, Laconia, N. H., U.S.A. under the name "KOMET" and had 8.89 cm (3.5 inch) diameter head; and consisted of 2.4 stitches per centimeter along the tube axis and 2.0 stitches per centimeter perpendicular to the tube axis.

Examples 1 and 2 and Comparative Examples 1–3

In these examples, the benefits of the invention are described for copper plating. Results of copper plating on fibers of this invention and on comparative fibers are shown in Table 1. In each case, a fabric tube was weighed and then plated using commercially available chemistries as follows:

(a) contacting the fabrics for about 10 minutes at about 40° C. with an aqueous activation solution of mineral acid, stannous chloride, and palladium, for example, a solution of 60 grams of Shipley Co. "Cataposit" 44, an aqueous tin chloride solution; and, for example, a solution of 540 grams of Shipley Co. "Cataprep" 404 in 1700 milliliters of water, to provide a palladium-tin complex for activating the fiber surfaces;

(b) rinsing the yarns for about 5 minutes in two changes of water at about 25°C.;

(c) immersing the yarns for about 20 minutes at about 40° C. in an aqueous plating bath containing, for example, 240 milliliters of Shipley Co. "Circuposit" 3350M; 84 milliliters of Shipley Co. "Circuposit" 3350A; 200 millimeters of Shipley Co. "Circuposit" 3350B; and 1,476 milliliters water; and (d) rinsing the yarns for about 7 minutes in two changes of water at about 25° C.

The dried, plated, tubes were weighed to determine amounts of copper plated.

TABLE 1

(Effect of Base DMSO Contact on Copper Plating)

| Example | Base Soln. | Duration (sec.) | Cu Pickup (Wt. %) | Resistance (ohms/square) | Comments |
|---|---|---|---|---|---|
| 1 | K(t-butoxide) 0.2M | 10 | 55.6 | 0.20,0.13,0.17 0.14,0.16,0.17 | No copper particles in rinse waters |
| 2 | K(t-butoxide) 0.05M | 10 | 51.3 | 0.62,0.83,0.56 0.54,0.60,0.75 | No copper particles in rinse waters |
| Comp. 1 | No | — | 41.4 | 250,13,42 39,330,5.0 | Copper particles in all rinses |
| Comp. 2 | Solvent only | 40 | 43.1 | 28,51,128 347,62,450 | Copper particles in all rinses |

Examples 1 and 2 demonstrate that contacting the fibers with a strong base in accordance with this invention permits heavy, strongly adherent, electroless plating. Degree of plating is indicated by the wt. percent copper pickup and adherence is indicated by lack of copper particles in the rinse waters and by the very low electrical resistance of the plating. The presence of copper particles in the plating rinse waters is taken as indication of poor adhesion of the copper to the substrate;—more particles indicating less adherence.

Examples 3 and 4 and Comparative Examples 3 and 4

In these examples, the benefits of the invention are described for nickel plating. Results of nickel plating on fibers of this invention and on comparative fibers are shown in Table 2. In each case, a fabric tube was weighed and then plated using commercially available chemistries as follows:

(a) contacting the fabrics for about 10 minutes at about 40° C. with an aqueous activation solution of mineral acid, stannous chloride, and palladium, for example, a solution of 60 grams of Shipley Co. "Cataposit" 44, an aqueous tin chloride solution; and, for example, a solution of 540 grams of Shipley Co. "Cataprep" 404 in 1700 milliliters of water, to provide a palladium-tin complex for activating the fiber surfaces;

(b) rinsing the yarns for about 5 minutes in two changes of water at about 25° C.;

(c) immersing the yarns for about 20 minutes at about 60° C. in an aqueous plating bath containing, for example, 300 milliliters of Witco Corporation "Niklad" 752A, an aqueous solution of 28.2 wt. % nickel compound, 5 wt. % ammonia and 66.8% water; 100 milliliters of Witco Corporation "Niklad" 752R, an aqueous solution of dimethylamine borane, and 1600 milliliters water; and (d) rinsing the yams for about seven minutes in two changes of water at about 25° C.

The dried, plated, tubes were weighed to determine amounts of nickel which were plated.

TABLE 2

(Effect of Base DMSO on Nickel Plating)

| Example | Basic Solution | Duration (sec.) | Ni Pickup (Wt. %) | Resistance (ohms/square) |
|---|---|---|---|---|
| 3 | K(t-butoxide) 0.2M | 2.5 | 46.5 | 0.16,0.17,0.16 0.18,0.17,0.15 |
| 4 | K(t-butoxide) 0.2M | 10 | 48.9 | 0.16,0.14,0.16 0.14,0.15,0.16 |
| Comp. 3 | No | — | 39.6 | 1.75,1.63,2.02 1.72,1.64 |
| Comp. 4 | Solvent Only | 40 | 45.8 | 0.76,0.66,0.72 1.17,0.72,0.83 |

Examples 3 and 4 demonstrate somewhat greater metal pickup and much less electrical resistance than the comparison examples.

Examples 5–7 and Comparative Examples 5 and 6

In these examples, the benefits of the invention are described for a variety of bases. Samples of fibers were contacted with bases as described in Examples 1 and 2, above, and were copper plated as described in those examples. Identification of the bases, along with base concentrations and duration of contact are shown, with the plating results, in Table 3.

TABLE 3

(Effect of Different Bases on Plating)

| Example | Base Solution | Duration (sec.) | Cu Pickup (Wt. %) | Resistance (ohms/sq.) | Comments |
|---|---|---|---|---|---|
| 5 | Na(amide) 0.2M | 10 | 54.5 | 0.29,0.28,0.27 0.30,0.28 | No copper particles in rinse waters |
| 6 | Na(t-butoxide) 0.2M | 30 | 54.9 | 0.32,0.39,0.38 0.45,0.34,0.41 | No copper particles in rinse waters |
| 7 | Na(methoxide) 0.2M | 10 | 53.4 | 0.50,0.58,0.34 0.29,0.45,0.49 | No copper particles in rinse waters |
| Comp. 5 | KOH saturated | 60 | 43.8 | 16,50,153 66,112,19 | Copper particles in all rinses |
| Comp. 6 | NaOH saturated | 60 | 45.5 | 7.9,14,7.7 5.0,200,38 | Copper particles in all rinses |

Examples 5–7 demonstrate that soluble alkali metal alkoxide and amide bases are effective for practice of this invention. Potassium and sodium hydroxide are substantially insoluble in DMSO and Comparative Examples 5 and 6 demonstrate that the process of this invention cannot be conducted without an adequate strong base supply.

We claim:

1. A process for preparing an aramid surface to be plated with a durable metal coating wherein, during the entire course of the process, the aramid surface is kept from contact with metal cations; the process consisting of the steps of:

a) contacting the aramid surface with a non-aqueous solution of a base, whose conjugate acid has a pKa in dimethyl sulfoxide of greater than 19, for 1 to 60 seconds at a temperature in the range from 15° C. to 190° C.; and b) washing the base-contacted aramid surface with water until substantially all of the base is removed.

2. The process of claim 1 wherein the base is present in concentration of 0.05M to 6M.

3. The process of claim 1 wherein the nonaqueous solution has dimethyl sulfoxide as a solvent.

4. The process of claim 1 wherein the base is potassium t-butoxide.

5. A process for plating an aramid surface with a durable metal coating wherein, during the course of the process up to step (c), below, the aramid surface is kept from contact with metal cations; the process consisting of the steps of:

a) contacting the aramid surface with a non-aqueous solution of a base, whose conjugate acid has a pKa in dimethyl sulfoxide of greater than 19, for 1 to 60 seconds at a temperature in the range from 15° C. to 190° C.;

b) washing the base-contacted aramid surface with water until substantially all of the base is removed; and c) immersing the washed aramid surface in an aqueous solution of metal cations to be plated.

6. The process of claim 5 wherein the base is present in concentration of 0.05M to 6M.

7. The process of claim 5 wherein the nonaqueous solution has dimethyl sulfoxide as a solvent.

8. The process of claim 5 wherein the base is potassium t-butoxide.

9. A process for plating an aramid surface with a durable metal coating wherein, during the course of the process up to step (c), below, the aramid surface is kept from contact with metal cations; the process consisting of the steps of:

a) contacting the aramid surface with a non-aqueous solution of a base, whose conjugate acid has a pKa in dimethyl sulfoxide of greater than 19, for 1 to 60 seconds at a temperature in the range from 15° C. to 190° C.;

b) washing the base-contacted aramid surface with water until substantially all of the base is removed;

c) drying the base-contacted and washed aramid surface; and d) immersing the dried aramid surface in an aqueous solution of metal cations to be plated.

10. The process of claim 9 wherein the drying is conducted at 15° C. to 80° C.

* * * * *